US007143562B2

(12) United States Patent
Krantz-Lilienthal et al.

(10) Patent No.: US 7,143,562 B2
(45) Date of Patent: Dec. 5, 2006

(54) SUSPENSION SYSTEM AND STRUCTURE FOR SECURING BORDER CEILING PANELS

(75) Inventors: Eric Krantz-Lilienthal, Lancaster, PA (US); Richard D. Stackenwalt, Dallastown, PA (US); James K. Kelley, Lancaster, PA (US)

(73) Assignee: AWI Licensing Company, Wilmington, DE (US)

( * ) Notice: Subject to any disclaimer, the term of this patent is extended or adjusted under 35 U.S.C. 154(b) by 0 days.

(21) Appl. No.: 10/618,825

(22) Filed: Jul. 14, 2003

(65) Prior Publication Data

US 2004/0172907 A1 Sep. 9, 2004

Related U.S. Application Data

(60) Provisional application No. 60/451,440, filed on Mar. 3, 2003.

(51) Int. Cl.
*E04B 9/00* (2006.01)

(52) U.S. Cl. ..... 52/506.06; 52/506.07; 52/506.08; 52/733.1; 52/220.6; 52/213

(58) Field of Classification Search ..... 52/506.06, 52/506.07, 506.08, 220.6, 733.1–733.4, 716.1, 52/716.8, 204.1, 211, 213, 220.7
See application file for complete search history.

(56) References Cited

U.S. PATENT DOCUMENTS

| | | | | | |
|---|---|---|---|---|---|
| 2,710,679 | A * | 6/1955 | Bibb et al. | ..... | 403/217 |
| 3,084,401 | A * | 4/1963 | Findlay | ..... | 52/476 |
| 3,386,220 | A * | 6/1968 | Staats | ..... | 52/777 |
| 3,473,282 | A * | 10/1969 | Robinson, Jr. | ..... | 52/664 |
| 3,977,144 | A * | 8/1976 | Jahn | ..... | 52/775 |
| 3,998,020 | A * | 12/1976 | Kuhr et al. | ..... | 52/506.07 |
| 4,047,348 | A * | 9/1977 | McSweeney | ..... | 52/506.06 |
| 4,281,498 | A * | 8/1981 | Kern | ..... | 52/780 |
| 4,406,104 | A * | 9/1983 | Beck et al. | ..... | 52/283 |
| 4,492,006 | A * | 1/1985 | Ishii | ..... | 24/382 |
| 4,610,562 | A * | 9/1986 | Dunn | ..... | 403/233 |
| 4,624,088 | A * | 11/1986 | Arent | ..... | 52/506.07 |
| 4,678,487 | A * | 7/1987 | Cadwell et al. | ..... | 55/385.1 |
| 4,901,485 | A * | 2/1990 | Menchetti et al. | ..... | 52/145 |
| 4,991,370 | A * | 2/1991 | Gailey et al. | ..... | 52/506.1 |
| 5,046,294 | A * | 9/1991 | Platt | ..... | 52/506.06 |
| 5,072,547 | A * | 12/1991 | DiFazio | ..... | 49/504 |
| 5,177,929 | A * | 1/1993 | Reynolds | ..... | 52/745.05 |
| 5,239,801 | A * | 8/1993 | Adams | ..... | 52/506.07 |
| 5,279,090 | A * | 1/1994 | Yamaguchi et al. | ..... | 52/506.08 |
| 5,287,668 | A * | 2/1994 | Dall et al. | ..... | 52/506.08 |
| 5,572,844 | A * | 11/1996 | Stackenwalt et al. | ..... | 52/506.07 |
| 5,619,833 | A * | 4/1997 | Neff | ..... | 52/506.07 |
| 5,893,250 | A * | 4/1999 | Benvenuto et al. | ..... | 52/506.08 |
| 5,937,605 | A * | 8/1999 | Wendt | ..... | 52/506.06 |
| 5,979,134 | A * | 11/1999 | Neff | ..... | 52/506.07 |
| 6,438,921 | B1 * | 8/2002 | Moore | ..... | 52/655.1 |
| 6,516,582 | B1 * | 2/2003 | Paul et al. | ..... | 52/506.07 |
| 6,880,302 | B1 * | 4/2005 | Fontaine | ..... | 52/222 |

* cited by examiner

*Primary Examiner*—Jeanette E. Chapman

(57) ABSTRACT

An apparatus and system to secure a panel to suspended ceiling system which includes a plurality of suspension elements. The apparatus is a border structure that enables attachment of the panel to the suspension element. The border structure includes a plurality of horizontal surface members and a plurality of vertical sections, with a first horizontal surface member being inserted into a hanger secured to the suspension element, and with a second horizontal surface member supporting an end of a panel. At least one vertical section joins the plurality of horizontal surface members. A spring hold down clip secures the panel from unintended displacement during a seismic event.

22 Claims, 8 Drawing Sheets

SUSPENSION SYSTEM AND STRUCTURE FOR SECURING BORDER CEILING PANELS

This application claims the benefit of U.S. Provisional Application No. 60/451,440, filed Mar. 3, 2003.

FIELD OF THE INVENTION

The present invention relates generally to suspension systems, and more particularly, to a ceiling border structure which can be utilized in an suspended ceiling system. The border structure, also referred to herein as a border member, is secured to suspension channels in the ceiling system and not to a wall or partition. As a result, the border member can be utilized in island/floating ceiling systems. It is also desirable to utilize the border member of the invention in ceiling systems used in locations that experience low to severe seismic activity.

BACKGROUND

Suspended ceiling systems, including exposed metal grid systems for lay in panels and systems utilizing metal hook-on type panels, are extensively used in private and commercial buildings. Such ceiling systems are suspended from the building structure and provide a substantially uninterrupted planar ceiling appearance. Lighting fixtures, air handling vents and the like are often incorporated at various locations in the system.

Conventional suspended ceiling systems which utilize metal panels often include supporting grid elements structured to grip the upstanding edges of the metal panels. Ceiling systems utilizing metal panels have application to buildings that have large ceiling areas or high access areas. These systems are most frequently used in corridors, lobbies, entryways, and hospitality and retail spaces. The metal panels come in widths of varying sizes, are completely accessible and fully conceal the suspension system. The panels provide downward accessibility, requiring minimum plenum clearance.

In geographical regions subject to earthquakes, buildings are designed with lateral force resisting systems, i.e. seismic systems, to resist the effects of earthquake forces. Seismic systems make a building stiffer against horizontal forces, thus minimizing the amount of relative lateral movement and resultant damage. Although the buildings may be designed structurally to provide seismic resistance to lateral forces, the ceiling panels suspended adjacent the trim or border of the ceiling system remain very susceptible to displacement under severe environmental conditions. Thus, the connection of the wall or partition to the ceiling system, ceiling system members and their connections must be designed to support the reaction force of the wall or partition from prescribed loads applied perpendicular to the wall or partition during a seismic event.

FIGS. 1 and 2 illustrate a suspended asymmetric ceiling system which is typically utilized in areas subject to seismic disturbances. The panels positioned adjacent the wall, herein referred to as border panels, are supported by metal L-beam members, often referred to as wall angles, which are fastened to the wall with nails or screws. In this known configuration, the status of the border panels is partially dependent on the status of the wall or partition. By way of example, if the wall to which the wall angle is secured were to be collapse, the border panels supported by the wall angle would fall, potentially injuring people in the room below. Accordingly, there is a need for a ceiling system which secures border panels from unintended displacement. It is also desirable to allow for the border panels to be accessible as usual for installation and de-installation.

Also, island, or floating, ceiling systems, in which the termination of the ceiling plane stands proud of the wall, are in increasing demand as such systems provide an architect with substantially unlimited aesthetic variations in a ceiling system.

SUMMARY

The present invention provides a suspended ceiling system in which the border panels are secured to the suspension elements of a suspended asymmetric ceiling system. The ceiling system includes a plurality of suspension elements, a plurality of grid elements, a plurality of hangers and a plurality of border structures. Each hanger has a slot for attaching either a grid element or a border structure to a suspension element.

Each border structure has a plurality of horizontal surface members and a plurality of intervening vertical surface members. A first horizontal surface member can be inserted into a hanger slot for attaching the border structure to a suspension element. A second horizontal surface member supports a border panel. As a result, the border panel is attached to the suspended ceiling system and unintended displacement of the border panels is avoided should the wall be displaced.

Various other advantages stem from the ceiling system and border structure of the invention. One advantage is that the system is simpler and economical to use. For example, the system requires only one border structure extrusion as there is no need to design and manufacture custom sizes with custom miter cuts. The absence of the need for multiple extrusions results in savings in manufacturing and makes installation and replacement less complicated. In addition, as the border element is extruded and is therefore softer, it is easier to field cut. By being easier to field cut, the installer can feel more comfortable making various angle cuts on the border structure.

Further, the border element of the invention can be used at both wall and bulkhead locations. As the border element can be used in multiple locations, and as custom sizing is no longer required, it is practical to stock the border member. The ability to stock the border member results in a large reduction in manufacturing lead times, which can be utilized as a marketing tool. In addition, the border element eliminates the need to manufacture custom size panels to fit the architecture and standard suspension components placed on walls.

The invention possesses many other advantages, and has other purposes which may be made more clearly apparent from consideration of the example embodiments. The example embodiments are shown in the accompanying drawings and form part of the specification. The example embodiments will now be described in detail for the purpose of illustrating the general principles of the invention, but it is to be understood that the description of the example embodiments should not be considered limiting.

DETAILED DESCRIPTION OF THE DRAWINGS

The following description of the invention is provided as an enabling teaching of the invention in its best, currently known embodiment. Those skilled in the relevant art will recognize that many changes can be made to the embodiments described while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

Figure 1:
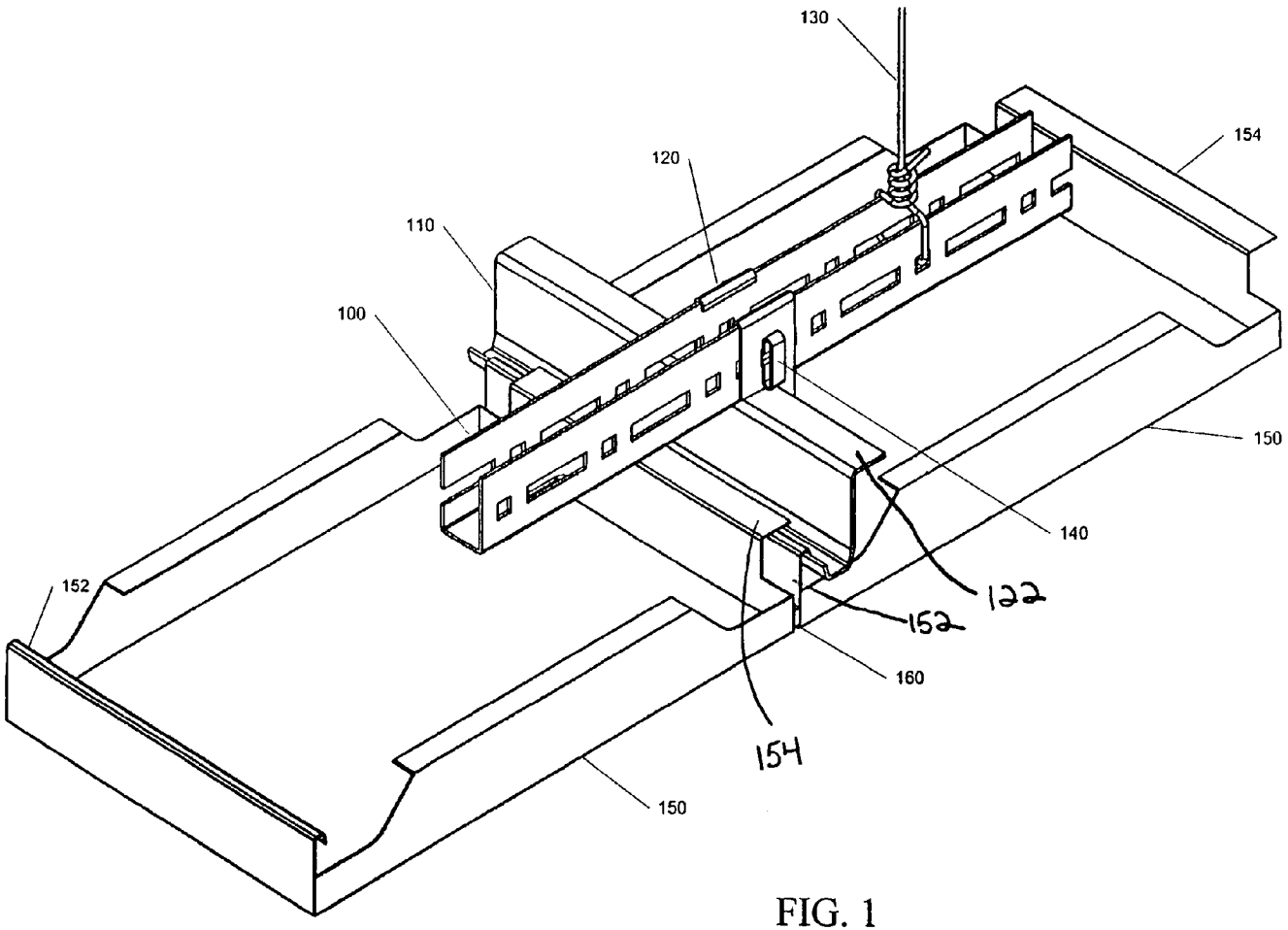
FIG. 1 (PRIOR ART)
FIG. 1 illustrates a perspective view of a section of a suspended ceiling system utilizing metal hook-on panels according to the prior art.
Figure 2:
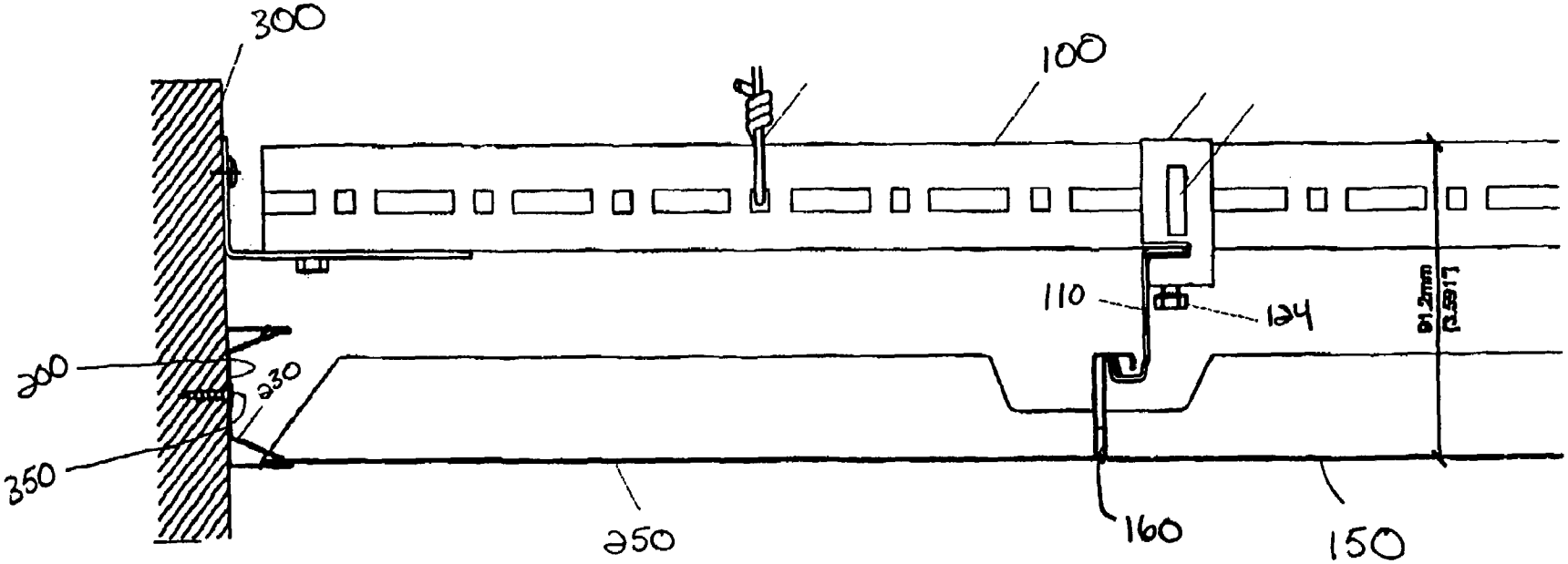
FIG. 2 (PRIOR ART)
FIG. 2 illustrates a side view of the suspended ceiling system of FIG. 1 wherein a cut panel is supported at a wall location according to the prior art.

FIG. 1 displays a known hook-on metal panel 150, such as the RH-200 metal panel available from Armstrong World Industries, installed in a known asymmetric J-bar suspension system. A typical asymmetric suspension system includes suspension elements, such as U-profiles, and grid elements, such as J-bars or H-bars. FIG. 1 illustrates a suspension system having a U-profile 100 being supported by 12-gauge hanger wire 130, spaced 4 feet on center. The system also has J-bar grid elements 110 which are attached to the U-profile 100 at every module, wherein a module is dictated by the length of a panel 150. The J-bar 110 is connected to the U-profile 100 with a hanger 120 having a slot in which the top straight leg 122 of the J-bar 110 is installed. A plug-in clip 140 can be used to secure the J-bar hanger 120 to the U-profile 100 at a desired module. The plug-in clip 140 can be formed from a single piece of resilient spring metal folded upon itself to define a base and first and second arms extending from the base in spaced relation. A fastener 124 (shown in FIG. 2), such as a bolt-type fastener, can be used to secure the straight leg 122 of the J-bar 110 in the hanger slot. FIGS. 1 and 2 also show how the edges 152, 154 of adjacent panels 150 are positioned over the J-bar 110. A foam gasket 160 may be used to separate and provide isolation between adjacent panels.

FIG. 2 shows a cut border panel 250 supported at a wall location according to the prior art. At the uncut end, the border panel 250 is hung from a J-bar 110. The cut end of the border panel 250 is typically positioned no closer than 0.5 inches from the bulkhead 200 and is held down by clip 230 which is also fixedly attached to the wall 300 by screw 350. The border panel 250 is not attached to the U-profile at the cut end. Although the end of the panel adjacent the border structure is often referred to herein as the cut end of the panel, it should be noted that it may not be necessary to cut this end if it is not required during installation.

Figure 3:
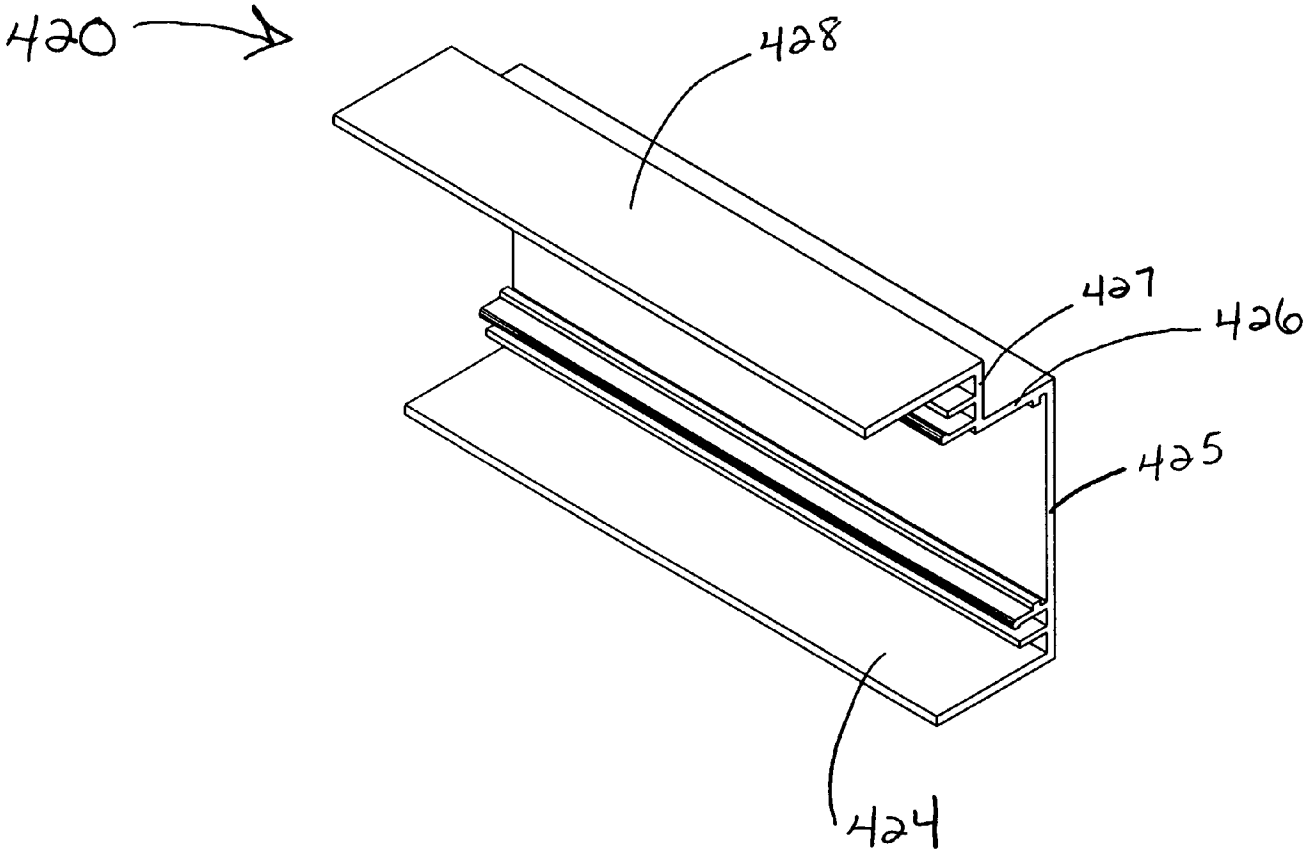
FIG. 3 illustrates a perspective view of a border structure in accordance with an exemplary embodiment of the invention.
Figure 4:
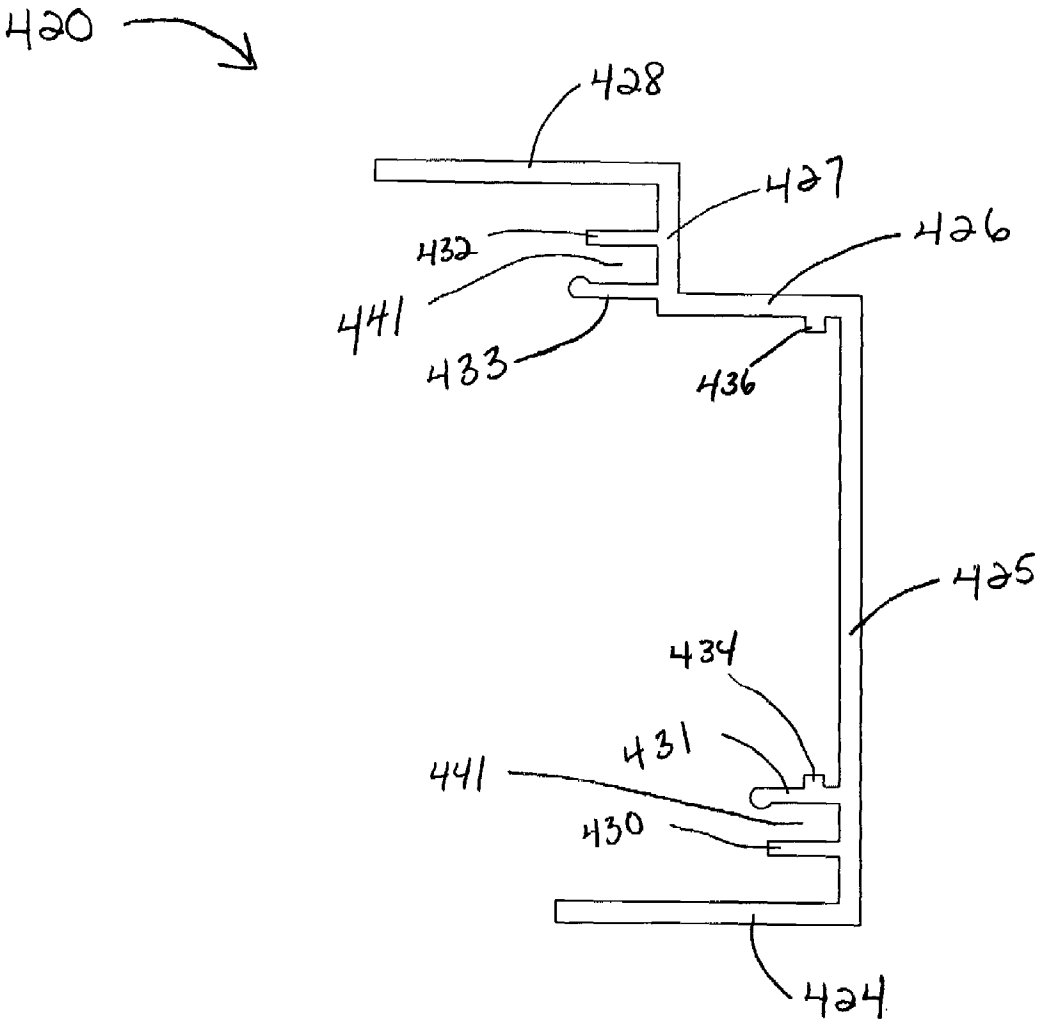
FIG. 4 illustrates a side view of the border structure of FIG. 3.
Figure 5:
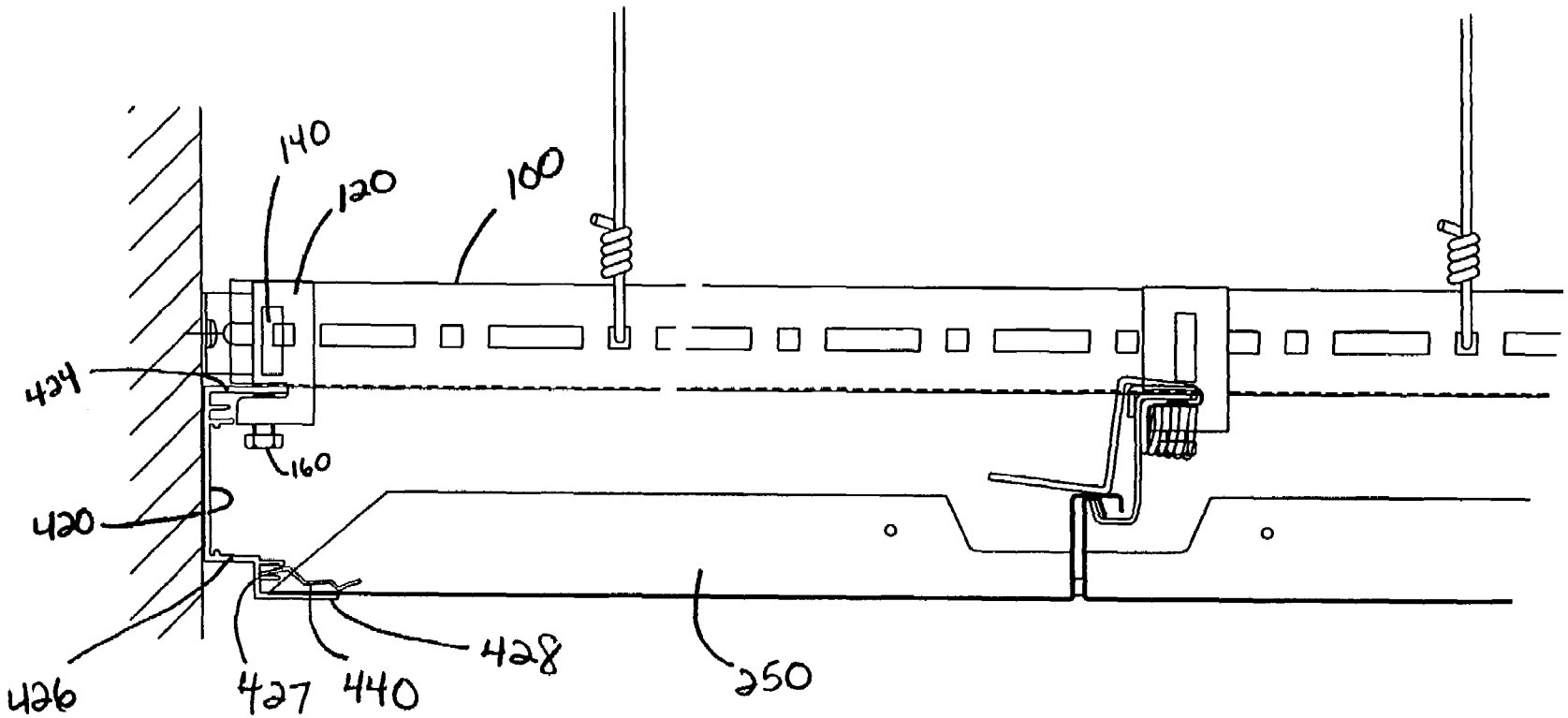
FIG. 5 illustrates a side view of a portion of a suspended ceiling system utilizing the border structure of FIG. 3.
Figure 6:
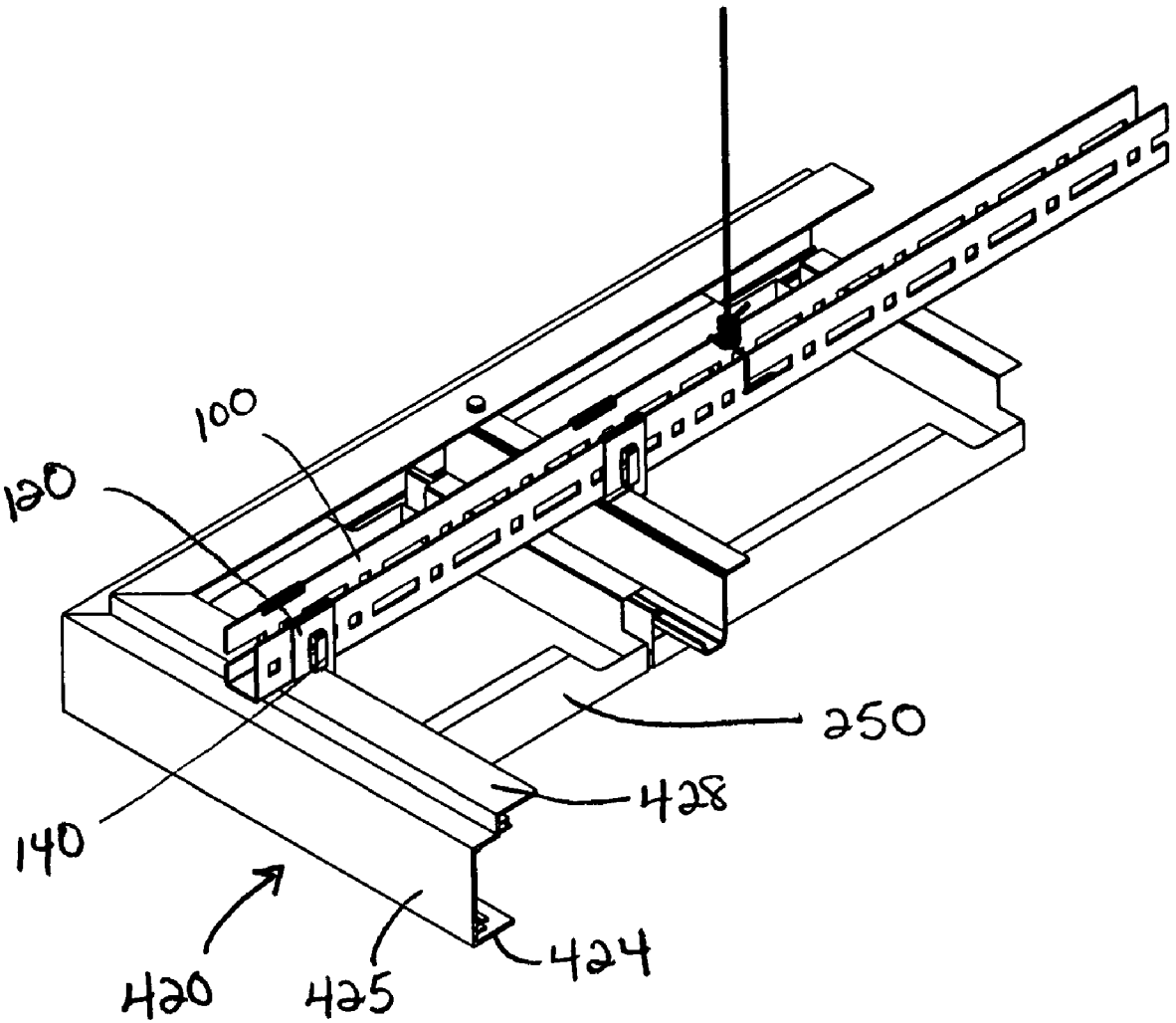
FIG. 6 illustrates a perspective view of a portion of a suspended ceiling system utilizing the border structure of FIG. 3.

FIGS. 3 and 4 display a border structure according to the present invention which is attachable to a suspension element, such as a U-profile, and is capable of supporting a border panel. The border structure 420 includes a plurality of horizontal surface members and a plurality of intervening vertical sections which join the plurality of horizontal surface members. The border structure 420 includes first and second horizontal surface members, 424 and 428 respectively. As shown in FIG. 5, the first horizontal surface member 424 can be inserted in the slot of the J-bar hanger 120 to secure the border structure 420 to the U-profile 100. As shown in FIG. 6, the border structure can be rotated 180° so that the second horizontal surface member 428 can be inserted and secured in the slot of the J-bar hanger 120.

The border structure 420 also has first and second vertical sections, 425 and 427 respectively, and a third horizontal surface member 426 positioned between the first and second horizontal surface members 424, 428. The third horizontal surface member 426 adjoins the first and second vertical sections 425, 427. A first pair of hold down clip flanges, 430, 431 extend horizontally from the first vertical section 425. A second pair of hold down clip flanges, 432, 433, extend horizontally from the second vertical surface member 427. The first and second pairs of hold down clip flanges run the entire longitudinal length of the border element 420 and provide respective grooves 441 for placement of standard spring hold down clips 440. Having a groove 441 which runs along the entire length of the border member 420 allows an installer to cut the border member 420 at any location along its length.

FIG. 5 illustrates a spring hold down clip 440 positioned in groove 441 positioned proximate the horizontal surface member 428. As further shown in FIG. 4, flanges 431 and 433 may include a rounded edge to lock the spring hold down clip 440 in the groove 441 provided by the pairs of hold down clip flanges. The spring hold down clip 440 is tensioned and resilient when locked in groove 441. As a result, the spring hold down clip 440 is capable of securing the cut end of a border panel so that the border panel is not displaced from the border structure during a seismic event.

Further, a boss 434 extends vertically from flange 431 and is opposite from a second boss 436 which extends vertically from the third horizontal surface member 426. These bosses 434, 436 provide a channel for a simple connector 530 (shown in FIG. 8), such as a splice plate. The splice plate, which is typically composed of galvanized sheet steel, frictionally engages abutting border elements 420, even at corner locations. The channel, which runs the entire length of the border member 420, allows an installer to cut the border member 420 at any location and at any angle along the length of the border element 420. As a result, the need to design border elements having custom lengths and custom miter cuts is avoided.

The border structures can be formed by the extrusion of an aluminum sheet or a metal sheet. The border structure can also be roll-formed from a metal sheet.

As shown in FIGS. 5 and 6, the border element 420 can be attached to the J-bar hanger 120 by positioning either the first horizontal surface member 424 or second horizontal surface member 428 of the border element 420 in the slot of J-bar hanger 120. When the first horizontal surface member 424 is inserted in the slot of the hanger 120, as shown in FIG. 5, the second horizontal surface member 428, the second vertical section 427 and third horizontal surface member 426 provide a step molding visual aspect. When the second horizontal surface member 428 is inserted in the slot of the hanger 120, as shown in FIG. 6, the first horizontal surface member 424 and the first vertical section 425 provide a standard wall molding visual aspect.

A fastener 160 secures either the first or the second horizontal surface member in the slot of the J-bar hanger 120. In turn, a plug-in clip 140 secures the J-bar hanger 120 to the U-profile 100. The border panel 250 is placed inside the border element 420 where it is supported by either the first or second horizontal surface members, depending on which of the first or second surface members is not inserted in the slot of the J-bar hanger 120. Thus, the border panel 250 is secured to the U-profile and, as a result, the status of the border panel is dependent on the status of the ceiling system, not the wall or partition.

Figure 7:
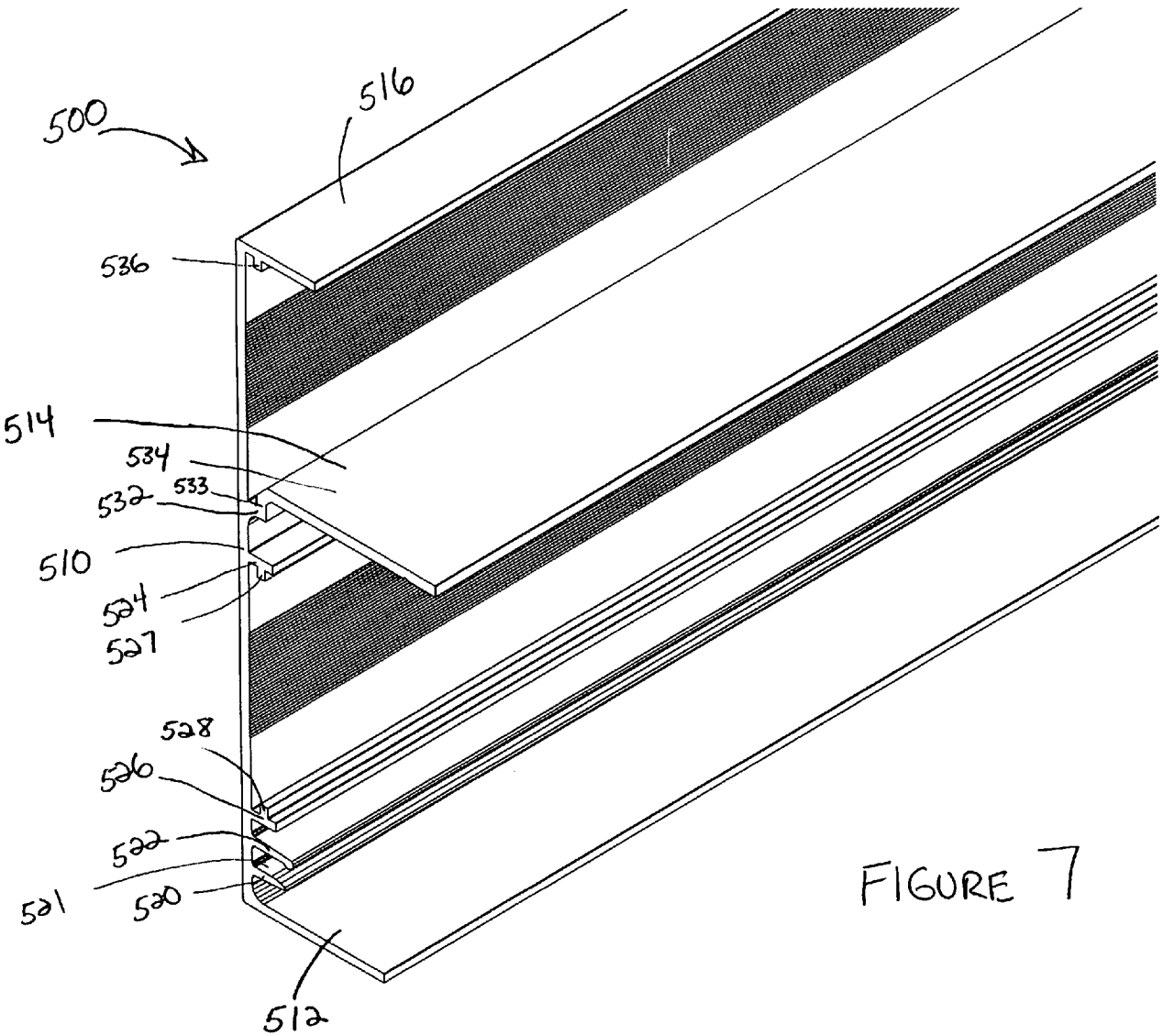
FIG. 7 illustrates a partial perspective view of a border structure in accordance with a second exemplary embodiment of the invention.
Figure 8:
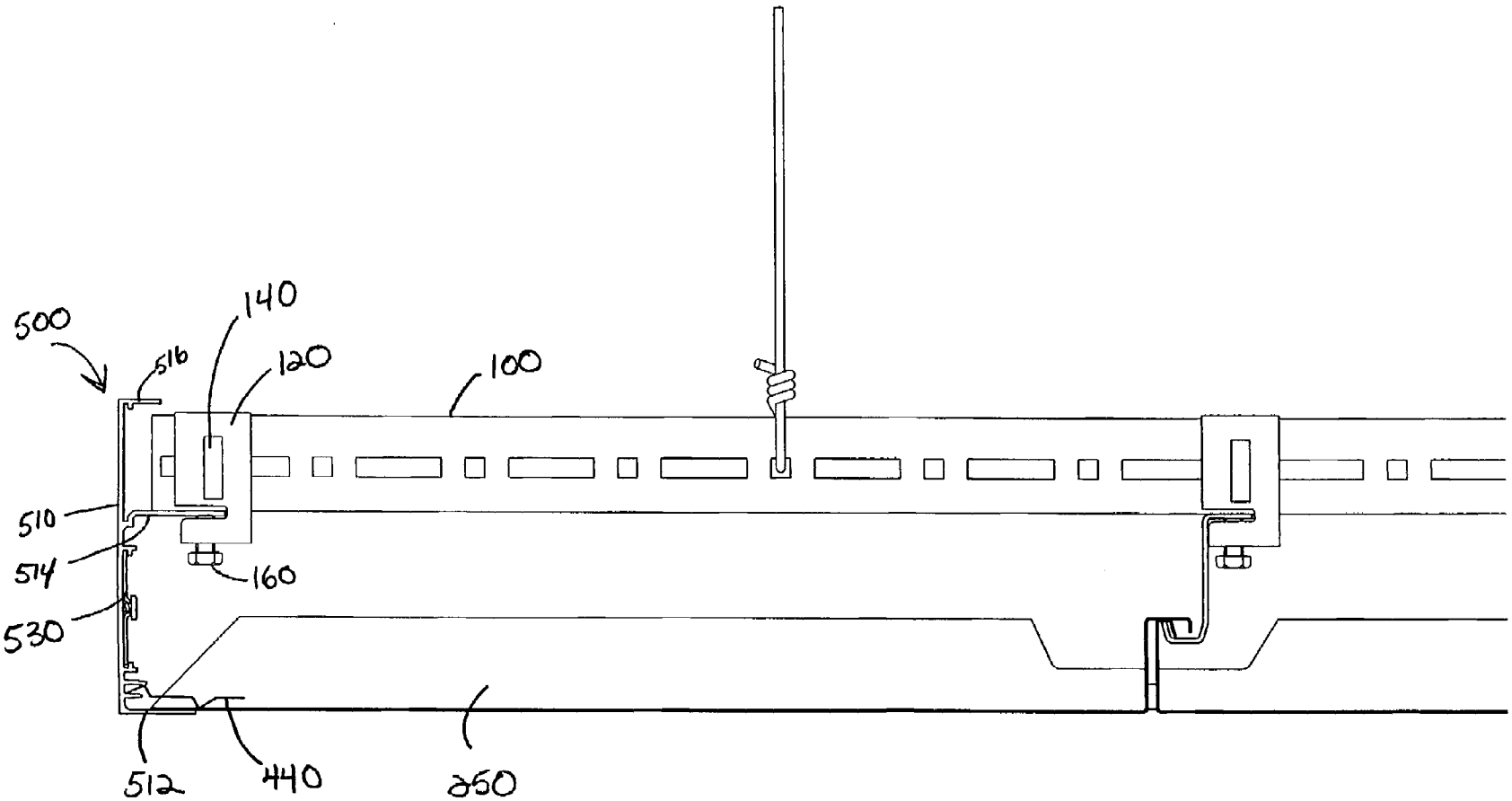
FIG. 8 illustrates a side view of a portion of a ceiling system utilizing the border structure of FIG. 7.

FIGS. 7 and 8 illustrate a second example embodiment of the border element. In this configuration, the border structure 500 includes a vertical section 510 and first surface member 512 extending horizontally from a first edge of the vertical section 510. The border element 500 further includes a second surface member 514 which extends horizontally from the vertical section 510 and is spaced apart from the first horizontal surface member 512. A pair of hold down clip flanges, 520, 522 also extend horizontally from the vertical section 510 adjacent the first horizontal surface member 512. The hold down clip flanges 520, 522 run the entire longitudinal length of the border element 500 and provide a groove 521 for placement of a standard spring hold down clip 440. Flange 522 may include a rounded edge distal the vertical section 510 to lock the spring hold down clip 440 in the groove 521. The spring hold down clip 440 secures the cut end of a border panel so that the border panel is not displaced from the border structure during a seismic event.

The border element 500 further includes a pair of splice plate support flanges 524, 526 extending horizontally from the vertical section 510 and positioned between hold down clip flange 522 and the second horizontal surface member 514. A first boss 527 extends vertically from splice plate support flange 524 and is opposite a second boss 528 extending vertically from splice plate support flange 526. These bosses 527, 528 provide a splice channel for splice plate support.

For additional splice plate support, additional splice plate channels are provided. As shown in FIG. 7, the second horizontal surface member 514 has a first portion 532 extending horizontally from the vertical section S10 and a second portion 534 extending horizontally in a plane offset from the first portion 532. The second portion 534 is connected to and spaced vertically apart from the first portion 532 by an intervening substantially vertical portion 533. The border structure 500 can further include a third surface member 516 which extends horizontally from a second edge of the vertical section 510, opposite the first edge. A boss 536 extends vertically from the third horizontal surface member 516 and is located opposite the substantially vertical portion 533 of the second horizontal surface member 514. The boss 536 of the third horizontal surface member 516 and the substantially vertical portion 533 provide a splice channel.

As shown in FIG. 8, the border element 500 can be attached to the J-bar hanger 120 by positioning the second portion 534 of the second horizontal surface member 514 in the slot of J-bar hanger 120. When the second horizontal surface member 514 is inserted in the slot of the hanger 120, the first horizontal surface member 512, which is adjacent the room below, supports a border panel and, along with the vertical section 510, provides a standard wall molding visual aspect. This example embodiment of the border element 500 can also be utilized at a location in the interior of a room, such as in an island ceiling system. The border element 500 is preferably used in island ceiling systems as the border element 500 is able to cover the basic framework of the suspension system adjacent the border element 500.

The corresponding structures, materials, acts, and equivalents of all means plus function elements in the claims below are intended to include any structure, material, or acts for performing the function in combination with other claim elements as specifically claimed. Those skilled in the art will appreciate that many modifications to the exemplary embodiments of the present invention are possible without departing from the spirit and scope of the present invention.

We claim:

1. The An apparatus for securing a border ceiling panel in a suspended ceiling system having a plurality of suspension elements, the apparatus comprising:

a border structure for attachment of the panel to the suspension element, the border structure includig a plurality of horizontal and vertical surface members, wherein a horizontal surface member is inserted into a hanger secured to a suspension element, and wherein another horizontal surface member supports a first end of a border ceiling panel, the another horizontal surface member supporting the first end of the border ceiling panel has no rib extending therefrom;

a second end of the border panel being supported by a grid element which is attached to a suspension element, wherein the grid element is a J-bar structure.

2. The apparatus of claim 1, further comprising a plug-in clip to secure the hanger to the suspension element.

3. The apparatus of claim 1, further comprising a spring clip, the spring clip keeping a cut end of a border panel from displacement from the border structure during a seismic event.

4. The apparatus of claim 1, wherein the grid element is attached to the suspension element by a hanger.

5. The apparatus of claim 1, wherein the suspension element is a U-profile structure.

6. The apparatus of claim 1, wherein the border structure is fabricated from a metal sheet.

7. The apparatus of claim 1, wherein the border structure is formed by an extrusion of metal.

8. The apparatus of claim 1, wherein the border structure is roll-formed from a metal sheet.

9. A suspension system for securing ceiling panels at a ceiling trim location, the system comprising:

a suspension element positioned horizontally;

a plurality of hangers attached to the suspension element;

a border structure supporting a first end of a ceiling panel, the border structure being supported by the suspension element; and a grid element supporting a second end of a ceiling panel, the grid element being supported by the suspension element;

wherein the hangers attach the border structure and grid element to the suspension element.

10. The system of claim 9, wherein each border structure includes a plurality of horizontal surface members, wherein a first horizontal surface member is positioned in a slot in the hanger whereby the border structure is supported by the suspension element and the border panel is positioned in the border structure between the first and second horizontal surface members.

11. The system of claim 9, further comprising a plurality of plug-in clips which secure the plurality of hangers to the suspension element.

12. The system of claim 9, wherein the horizontal suspension element has a U-profile.

13. The system of claim 9, wherein the grid element is a J-bar.

14. The system of claim 9, wherein the border structure is formed by a metal extrusion.

15. The system of claim 9, wherein the border structure is roll-formed from a metal sheet.

16. The system of claim 9, wherein the border structure comprises a spring hold down clip to secure a cut end of a ceiling panel from displacement from the border structure during a seismic event.

17. The system of claim 9, wherein the ceiling panel has a cut end which is supported by a border structure.

18. The system of claim 9, wherein the border structure is adjacent a wall.

19. The system of claim 9, wherein the border structure is spaced from a wall.

20. The A border structure 20 comprising:

a first horizontal surface member for supporting an end portion of a panel;

a second horizontal surface member;

a third horizontal surface member positioned between the first and second horizontal surface members;

a first vertical section integrally connecting the first horizontal surface member and the third horizontal surface member; and a second vertical section integrally connecting the second horizontal surface member and the third horizontal, wherein the first vertical section extends in a plane offset from the second vertical section, wherein each of the first and second vertical sections include a pair of hold down clip flanges which extend horizontally from the first and second vertical sections.

21. The border structure of claim 20, wherein the border structure is formed by a metal extrusion.

22. The border structure of claim 20, wherein the border structure is fabricated from a metal sheet.

* * * * *

UNITED STATES PATENT AND TRADEMARK OFFICE

CERTIFICATE OF CORRECTION

PATENT NO. : 7,143,562 B2
APPLICATION NO. : 10/618825
DATED : December 5, 2006
INVENTOR(S) : Krantz-Lilienthal et al.

It is certified that error appears in the above-identified patent and that said Letters Patent is hereby corrected as shown below:

Column 6
Claim 1, Line 17, Remove the first word "The"

Column 8
Claim 20, Line 1, Remove the first word "The"
Claim 20, Line 1, Remove the number "20"

Signed and Sealed this

Seventeenth Day of April, 2007

JON W. DUDAS
*Director of the United States Patent and Trademark Office*